United States Patent [19]

Harrison

[11] Patent Number: 5,056,336

[45] Date of Patent: Oct. 15, 1991

[54] SCROLL APPARATUS WITH MODIFIED SCROLL PROFILE

[75] Inventor: Mark W. Harrison, Onalaska, Wis.

[73] Assignee: American Standard Inc., New York, N.Y.

[21] Appl. No.: 318,876

[22] Filed: Mar. 6, 1989

[51] Int. Cl.[5] ..... F04C 18/04; F25B 1/04

[52] U.S. Cl. ..... 62/498; 418/55.2

[58] Field of Search ..... 418/55.2; 62/498

[56] References Cited

U.S. PATENT DOCUMENTS

| | | | |
|---|---|---|---|
| 3,874,827 | 4/1975 | Young | 418/55 A |
| 4,382,370 | 5/1983 | Suefuji et al. | 62/498 |
| 4,382,754 | 5/1983 | Shaffer et al. | 418/55 A |
| 4,441,870 | 4/1984 | Ikegawa et al. | 418/55 A |
| 4,490,099 | 12/1984 | Terauchi et al. | 418/55 A |
| 4,547,137 | 10/1985 | Terauchi et al. | 418/55 A |
| 4,558,997 | 12/1985 | Sakata et al. | 418/55 A |
| 4,594,061 | 6/1986 | Terauchi | 418/55 A |
| 4,678,415 | 7/1987 | Hirano et al. | 418/55 A |
| 4,781,549 | 11/1988 | Caillat | 418/55 A |

FOREIGN PATENT DOCUMENTS

| | | |
|---|---|---|
| 62-87601 | 4/1987 | Japan . |
| 62-107283 | 5/1987 | Japan . |
| 63-205481 | 8/1988 | Japan . |
| 63-215891 | 9/1988 | Japan . |
| 63-215892 | 9/1988 | Japan . |

*Primary Examiner*—John J. Vrablik

*Attorney, Agent, or Firm*—William J. Beres; William O'Driscoll; David L. Polsley

[57] ABSTRACT

In a scroll apparatus for fluid compression, two interfitting involute scroll elements with inner wall surfaces, each defined by an inner tip portion, an adjacent intermediate portion, an outwardly tending arcuate portion for periodic engagement in moving line contact with the inner tip of the other respective scroll element, and an involute portion extending from the arcuate portion to an outer end of the scroll element. When the involute scroll element inner tip is in moving line engagement with the arcuate portion of the other element, the scroll elements cooperates to define sealed final compression chambers of decreasing volume bounded by the intermediate portion of the scroll elements adjacent the respective inner tips, providing an extended duration of final compression as compared to a scroll apparatus having modified scroll elements. Furthermore, the arcuate portions and intermediate portions define an involute scroll wrap element having a thickened inner tip portion for increased strength and improved discharge flow from the final compression chambers to the discharge port.

14 Claims, 5 Drawing Sheets

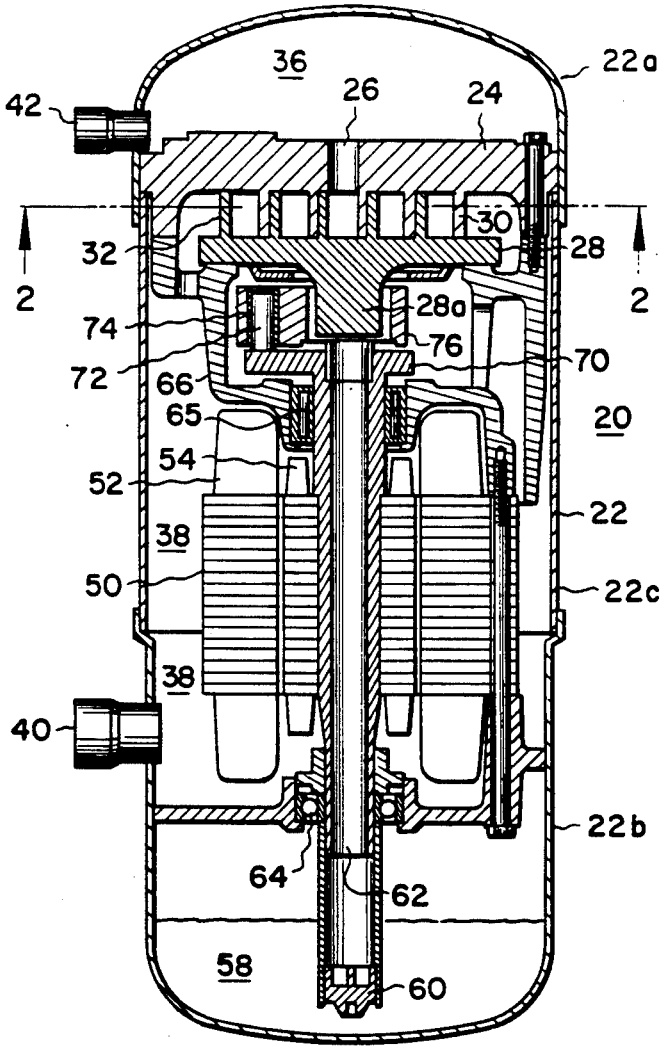
FIG. 1
FIG. 2
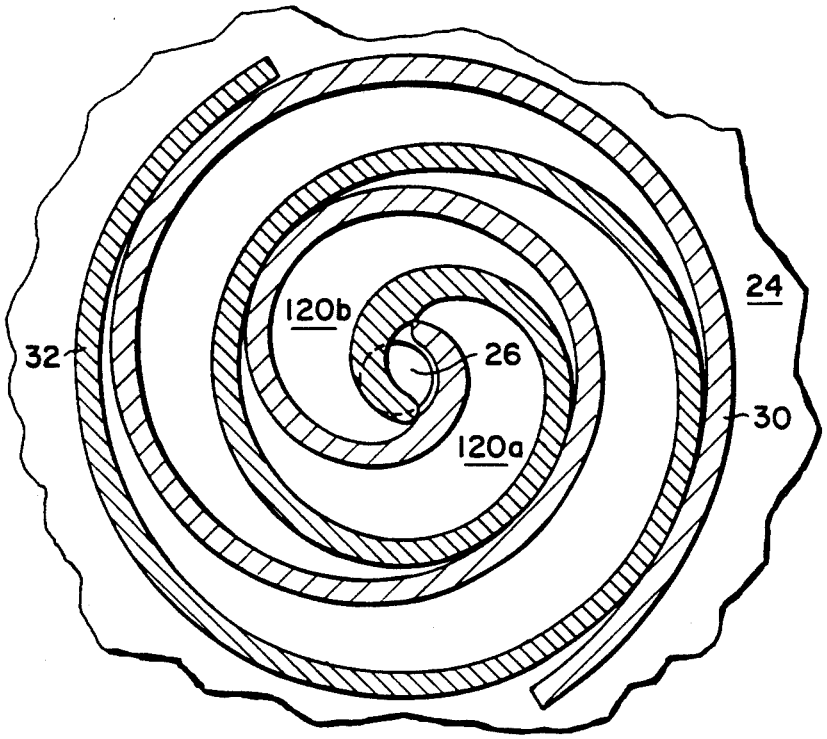

FIG. 5
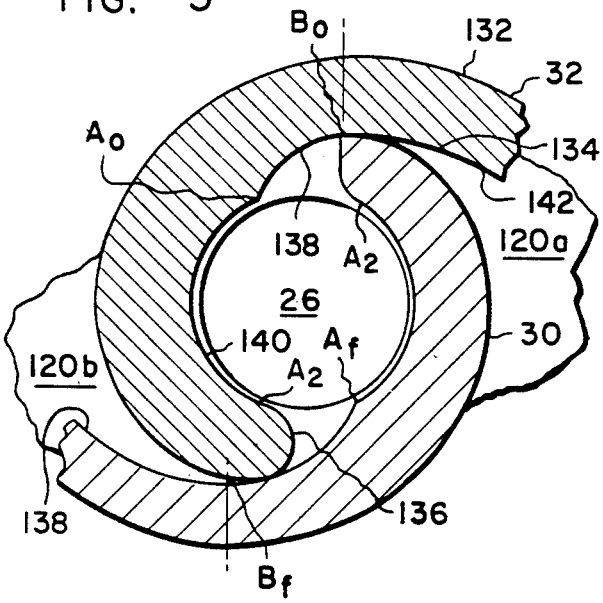
FIG. 6
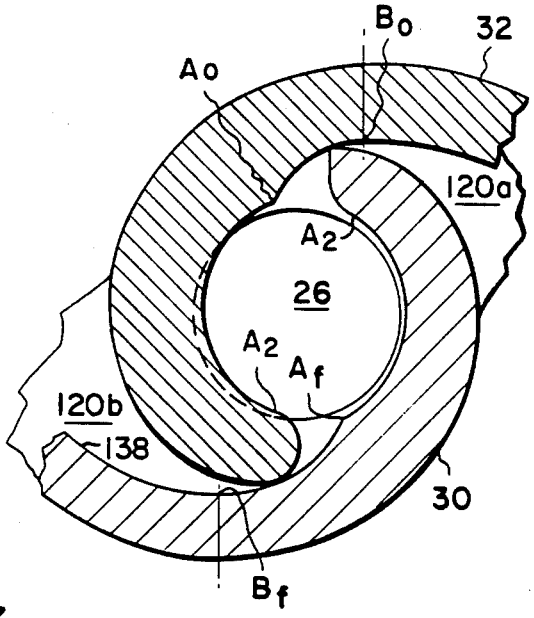
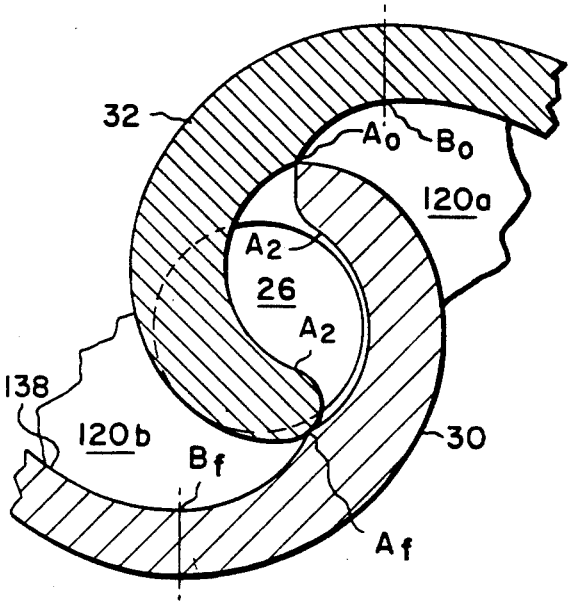
FIG. 7
FIG. 8
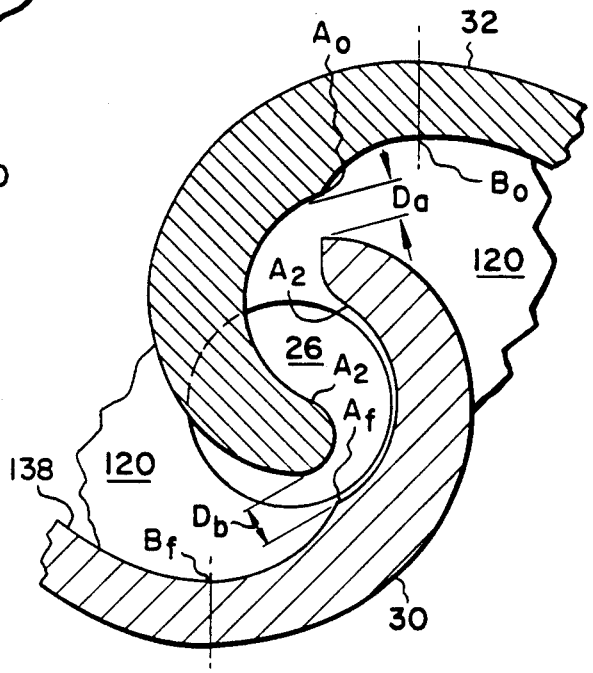

SCROLL APPARATUS WITH MODIFIED SCROLL PROFILE

DESCRIPTION

1. Technical Field

This invention generally pertains to scroll apparatus and specifically to scroll apparatus having involute scroll wrap elements conformed to provide enhanced, extended final compression and improved discharge flow in the scroll apparatus.

2. Background Art

A typical scroll apparatus includes two parallel, planar end plate members capable of relative orbital, non-rotating movement. Each of these planar members is fitted with or may integrally include an involute component or element upstanding on the face of the planar member. The involute is generally of spiral form, for interleaving engagement with the involute on the other respective planar member The interleaving involutes also known variously as scrolls, involute elements or wrap elements cooperate to define a plurality of moving line contacts forming therebetween a plurality of chambers bounded by the scroll elements and the scroll end plate members. These chambers, depending upon the clockwise or counter-clockwise orbital motion of the orbiting member, are of increasing or decreasing volume to cause the scroll apparatus to function as an expander or compressor. The general principles and basic operation of such a scroll apparatus is more fully set forth in U.S. Pat. No. 801,182, the disclosure of which is incorporated herein by reference When a scroll apparatus is used as a compressor, a discharge port or aperture is provided in at least one of the planar members (preferably known as end plates) adjacent the inner tips of the respective involute member. As the involute scroll elements move through the orbital motion, two final compression chambers are formed immediately adjacent the inner tip portions of the elements, which discharge into the discharge port chamber of the scroll elements when the tips separate from the inner surfaces of the opposing scroll elements. The rate at which the tips separate from the scroll elements limits the rate at which compressed fluid can flow from the final compression chambers to the discharge port.

Therefore, the disposition and size of the discharge port and shape of the involute element at and adjacent the inner tip of the respective involute elements is critical to the satisfactory operation of a scroll apparatus The disposition and sizing of the discharge port, in conjunction with the point at which the inner tips separate from the adjacent scroll elements, sets the point at which discharge begins and ends as well as the amount of time available for discharge, while the size of the discharge port limits the maximum flow capacity of the apparatus Improper disposition and sizing of the discharge port can cause excessive pressure buildup in the final compression chambers which can exceed the mechanical strength of the material used in the construction of the involute elements. In this event, the involute elements can deform or even separate from the end plate, rendering the scroll apparatus inoperable. Furthermore, the interaction of the inner tips of the respective involute elements is crucial to providing sufficient discharge time from the final compression chambers to permit adequate and efficient compression without unduly limiting the capacity of the scroll apparatus.

Attempts have been made to overcome these problems. It is not uncommon to provide a secondary flow path from the final compression chambers to the discharge chamber. Typically this secondary flow path is in the form of a "dummy" discharge port, which is a recess or blind hole in the end plate not having the actual discharge port. However, this "dummy" discharge port requires an additional precision machining step during manufacture, increasing the cost of the scroll apparatus. Furthermore, the "dummy" discharge port only serves to improve the initial discharge flow rather than improving discharge flow throughout the time of discharge.

Alternatively, the inner wall surface of the involute scroll elements may be modified at and adjacent to the inner tip.

An example of such a modification is U.S. Pat. No. 4,547,137, which teaches a modified inner tip structure comprised of an inner tip with a linear portion adjacent thereto on the inner wall of the scroll involute. The linear inner wall portion extends a given distance along the inner wall before rejoining the inner wall involute surface by a connecting circular arc portion. The bulk of the wrap element of the scroll is comprised of an inner and outer wall surface defining an involute of a constant thickness. This patent further teaches that the discharge port should be disposed through the end plate supporting the scroll wrap in such a manner that the discharge port undercuts at least a portion of the base of the wrap element. This approach tends to weaken the wrap element even though the involute scroll element thickness is increased because the mechanical connection area between the wrap element and the end plate of the scroll is decreased Also this approach provides only limited discharge chamber flow due to the relatively small volume between the linear involute inner wall surfaces.

Alternatively, the involute inner wall may be modified adjacent the inner tip by providing an arc portion of a circle tending into the wrap, i.e., having a decreasing involute element thickness with the involute inner wall surface tending toward the involute outer wall surface as measured therebetween when proceeding from the outer tip to the inner tip of the wrap element This approach, however, undesirably reduces the element strength and increases its susceptibility to failure due to the fluid pressure during final compression Therefore, it is an object of the subject invention to provide a modified scroll wrap element having increased wrap element thickness adjacent the inner tip.

It is a further object of the invention to provide a modified wrap element with a discharge port of suitable flow capacity which does not undercut the wrap element in the scroll end plate It is yet another object of the invention to provide a modified wrap element having extended final compression prior to discharge.

It is yet another object of the invention to provide such a modified wrap element having improved discharge flow from the final compression chambers.

It is yet another object of the invention to provide such a modified scroll apparatus so as to eliminate the need for a nonfunctional discharge port for fluid pressure relief during final compression.

It is yet another object of the invention to provide such a modified scroll wrap element which is relatively inexpensive and simple to manufacture.

These and other objects of the invention will be apparent from the attached drawings and the description of the preferred embodiment that follows hereinbelow.

SUMMARY OF THE INVENTION

The subject invention is a scroll apparatus having at least two interleaving scroll wrap elements with modified inner wall involute portions adjacent to the inner tip of each of the respective scroll wrap elements. Each of the scroll wrap elements has an inner tip portion for engagement with the other respective scroll, an intermediate portion adjacent to the inner tip portion and extending along the inner wall of the wrap element involute for defining a relatively thickened portion of the wrap element, and a circular arc portion adjoining said inner wall intermediate portion and the involute of the inner wall. The circular arc portion tends out of the inner wall of the wrap element to define an increasing thickness of the wrap element when proceeding from the outer end of the circular arc portion to the inner end of the circular arc portion. In operation, final compression chambers are defined during a portion of the scroll orbit by the engagement of the respective inner tips with the circular arc portion of the inner wall surface of the other respective scroll wrap element so that the final compression period is extended During the discharge portion of the scroll orbit immediately after compression, the discharge flow area increases rapidly between the involute scroll element inner tips and the circular arc portions.

BRIEF DESCRIPTION OF THE DRAWINGS

FIG. 1 shows a cross-sectional view of a scroll compressor embodying the subject invention FIG. 2 shows a cross-sectional view of the scroll compressor of FIG. 1 as taken through section line 2—2.

FIG. 5 through 8, inclusive, show enlarged views of the involute scroll elements of the scroll compressor of FIG. 1 in various positions of the scroll orbit.

DESCRIPTION OF THE PREFERRED EMBODIMENT

Figure 3:
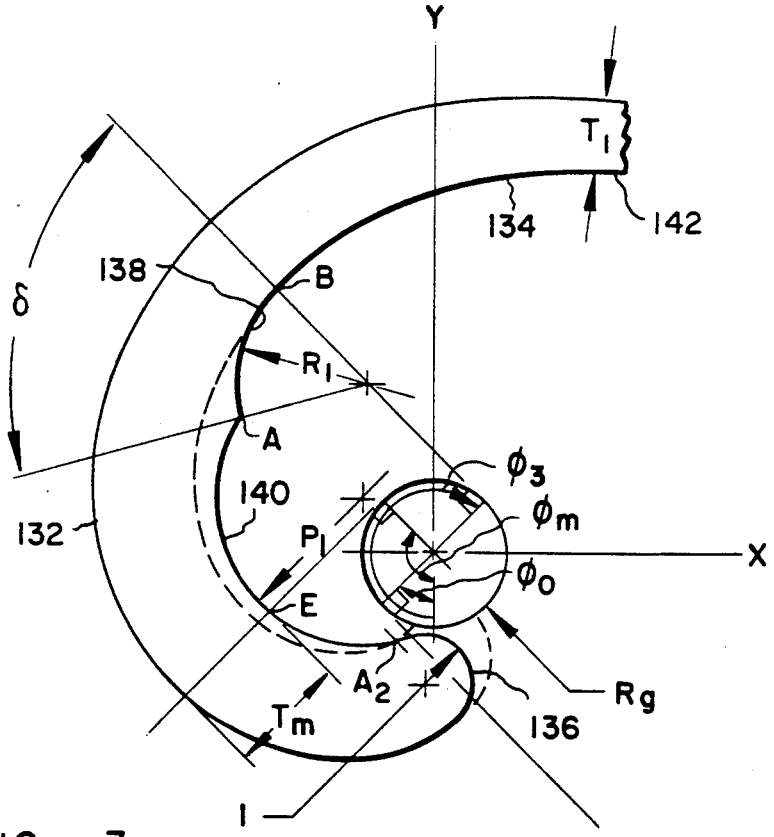
FIG. 3 illustrates the first interfitting scroll.

A scroll apparatus including the subject invention is generally represented by reference numeral 20 as shown in FIG. 1. For simplicity of description, the scroll apparatus 20 is described as a hermetically enclosed compression apparatus suitable specifically for use as a refrigerant compressor in a refrigeration system. Therefore, the scroll apparatus 20 will interchangeably be referred to as the compressor 20 or the refrigerant compressor 20. It is to be understood that such a scroll apparatus 20 would also be suitable as an expansion device or in other fluid compression or pumping uses, that it need not be hermetically enclosed, and that this description should therefore be taken as exemplifying the preferred embodiment of the subject invention rather than as limiting.

The scroll apparatus 20 comprises a hermetic shell 22 which includes an upper portion **22*a* and a lower portion 22*b*. A generally cylindrical center portion 22*c* is shown disposed between the upper portion 22*a* and the lower portion 22*b*. and the upper portion 22*a* and lower portion 22*b*** by such suitable means as weldments.

Disposed within the hermetic shell 22 is a planar first scroll end plate 24 having a centrally located aperture defining a discharge port 26 A planar second scroll end plate 28 is disposed in a parallel spaced relationship with respect to the first scroll 24. A first upstanding vertical wrap or involute scroll wrap element 30 is disposed on the first scroll end plate 24 and a second upstanding vertical wrap or involute scroll wrap element 32 is disposed on the second scroll end plate 28 such that the respective involute wraps are interleaving engagement defining a plurality of pockets having volume decreasing toward the center of the respective wraps.

In the preferred embodiment, as shown in FIG. 1, the first scroll 24 is fixed and the second scroll 28 is driven in an orbiting, non-rotating manner with respect to the first scroll 24. It is understood that the subject invention would work equally well in a corotating scroll apparatus, wherein the first scroll member 24 is rotated concurrently with the second scroll member 28 about parallel, nonconcentric axes to achieve the desired relative orbital motion between the respective scrolls.

Generally, the scroll-type apparatus operates by moving sealed pockets of fluid from one region at one pressure to another region at a different pressure. The first scroll 24 and the second scroll 28 cooperate to define the sealed pockets of fluid by the interleaving cooperation of the involute wraps 30 and 32 between the parallel planes defined by the end plates 24 and 28 of the respective scrolls. As the second scroll 28 is orbited with respect to the first scroll 24, at least two moving lines of contract are generated between the respective involute scrolls 30 and 32, creating a sealed pocket bounded by the end plates 24 and 28 of the respective scrolls and the surfaces of the respective involute scroll wrap elements 30 and 32. When the sealed pocket is moved toward the radially inner ends of the involute wraps, the scroll apparatus 20 operates in compression, and when the sealed pocket is moved toward the radially outer ends of the respective involute wraps, the scroll apparatus 20 operates in decompression or expansion.

The fixed scroll member 24 further serves to divide the hermetic shell 22 into a discharge pressure portion 36 and a suction pressure portion 38 It is to be understood that the division of the hermetic shell 22 into the discharge pressure portion 36 and the suction pressure portion 38 could be accomplished in the rotary compressor by other means such as an independent barrier member, and that the use of the fixed scroll member 24 for this purpose is not to be taken as limiting. A suction connection 40 is provided to admit suction pressure refrigerant to the suction pressure portion 38 of the hermetic shell 22, and a discharge connection 42 is provided to remove discharge pressure refrigerant from the discharge pressure portion 36 of the hermetic shell 22.

The scroll apparatus 20 is driven by an internal electric motor 50 disposed within the suction pressure portion 38 of the hermetic shell 22. The electric motor 50 includes a stator 52 and a rotor 54. A drive shaft 56 passes through the rotor 54, with its lower end extending into a reservoir of oil 58. Disposed at the lower distal end of the drive shaft 56 is a centrifugal oil pump 60 operative to cause oil 58 to flow upward through an internal bore 62 within the drive shaft 56. The oil thus forced upward through the internal bore 62 lubricates surfaces subject to friction within the compressor system 20 such as the lower drive shaft main bearing 64 and upper drive shaft main bearing 65. The drive shaft bearings are supported in a framework 66 which is attached to the hermetic shell 22 and includes other bearings and structure necessary to support the orbiting scroll member 28.

The oil pump 60, motor 50, components of the motor 50 and the structures for supporting the motor 50 and the orbiting scroll 28 are not disclosed in detail, as they are believed to be generally well known and understood in the art. It is understood, for example, that oil pump 60 would be equally suitable if a gear-type or similar pump were employed in lieu of a centrifugal-type pump. Also, it may be desirable to provide a thrust bearing or to configure the framework 66 to cause fluid pressure to act on the orbiting scroll 28, for ensuring compliance of the orbiting scroll 28 axially.

The upper end of the drive shaft 56 includes a crank 70 having a crank pin 72 eccentrically disposed relative to the longitudinal axis of the drive shaft. The crank pin 72 is rotatably disposed within a bearing 74 in a swing link 76. Generally, the swing link 76 provides a radially compliant linkage to connect the crank pin to the orbiting scroll 28 by means of a drive stub 28*a* that extends from the orbiting scroll 28 opposite the second involute wrap 32 Alternatively, a slider block mechanism for providing radial compliance may be used in lieu of the swing link 76. The details of operation and construction of radially compliant linkages in scroll-type apparatus are disclosed in U.S. Pat. No. 3,924,977 and are generally well known to those skilled in the art.

The radially compliant mechanism of swing link 76 cooperates with a generally conventional Oldham coupling arrangement (not shown) to insure that the orbiting scroll 28 orbits in fixed angular relationship to the fixed scroll 24. The Oldham coupling is believed to be generally known in the art, but is disclosed in more detail in U.S. Pat. No. 4,522,575, the disclosure of which is incorporated by reference herein.

Turning now to FIGS. 2 through 8, inclusive, the modified involute form of the radially inner ends of the respective scroll wraps is disclosed in more detail.

Each of the involute scroll wrap elements 30 and 32 define an outer wall surface 132, an inner wall surface 134, and an inner tip portion 136 The inner wall surface 134 has a first point A and a second point B defined thereon with a circular arc portion 138 extending from point A to point B through angle delta. A connecting arc portion 140 extends from point A to adjoin the inner tip portion 136 at a point A2. The inner wall surface 134 further includes a third inner compression wall portion 142 extending from point B to the outer end of the scroll wrap 32 The scroll wrap 32 defines a constant thickness T1 between the third inner wall surface portion 142 and the outer wall surface 132 equivalent to that of an unmodified scroll involute wrap.

Figure 4:
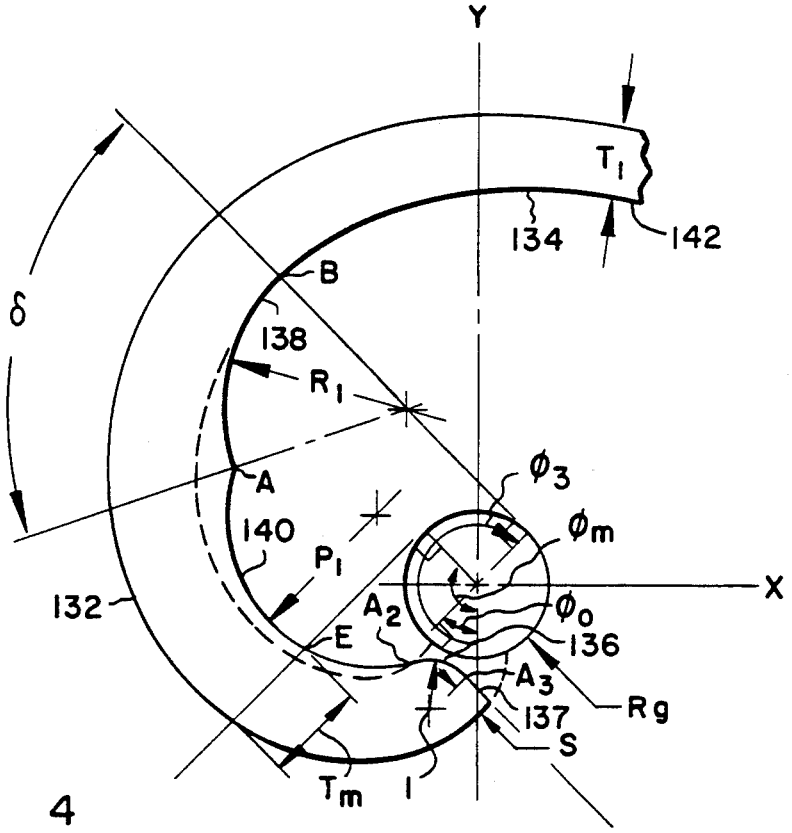
FIG. 4 illustrates the second interfitting scroll.

The dashed line seen in FIGS. 3 and 4 denote the disposition of the inner wall surface 134 in an unmodified scroll wrap between points A2 and B. It can clearly be seen that the connecting arc portion 140 diverges from the outer wall surface 132 from point A2 to A. increasing the thickness T of the scroll wrap 32 therebetween, and that the arc portion 138 extending from point A to point B tends into or converges to the thickness T1 of the unmodified scroll wrap at point B, causing a substantial increase in the thickness and strength of the scroll wrap 32 between the points A2 and B.

In the simplest terms, the scroll thickness T increases from a thickness T, which is preferable equal to T1 at point A2 to a maximum thickness T at point A, and decreases to the thickness T1 at point B.

The generation of the involute scroll wrap elements 30 and 32 are detailed in FIGS. 3 and 4 with respect to an (X,Y) coordinate axis diagram wherein the following variables are assumed to be equal: RG, the radius of generation upon which the involute wrap is based; $\phi 0$, the start angle which defines the beginning point for generation of the involute wrap as measured from the negative Y axis; $\phi 3$, which is measured clockwise from the negative Y axis for defining a tangent from the radius of generation circle setting the end point of the involute modification of the subject invention; and $\phi m$, which is also an angle defined as measured clockwise from the negative Y axis to determine the point at which the thickness of the modified involute wrap may be set.

Again, it should be noted that both FIGS. 3 and 4 show the respective scrolls in the same position with respect to an (X,Y) axis to facilitate an understanding of the subject invention. Those skilled in the art will recognize that either involute scroll element 30 or 32 can be generated by setting the appropriate positive or negative values for the (x,y) coordinates.

It will be apparent to those skilled in the art that the actual values selected for the foregoing variables will differ based on the size of the apparatus in which the respective scroll elements 30 and 32 are to be used For example. $\phi 0$ may be in the range of 15 degrees to 75 degrees or even more with a larger 0 permitting the use of a larger discharge port 26. While the larger discharge port 26 permits more rapid discharge flow, however, the linear measurement of the scroll wrap elements 30 and 32 must be increased to maintain a given pressure ratio Therefore, it is desirable to maximize the discharge flow rather than increase the discharge port size.

Referring now in particular to FIG. 3, a $\phi 0$ start angle and a radius of generation RG is selected so that the involute wrap start point is determined The radius of generation is drawn about the (X,Y) axis with a center at the 0,0 coordinate. A $\phi 3$ m is selected to define a line through the 0,0 coordinate across the RG circle, and a tangent is taken from the $\phi 3$ line which intersects the involute wrap at point B. At point B, the thickness of the involute wrap is T1. The thickness T1 of the involute scroll wrap element 30 and 32 is constant from point B to the outer end of the scroll element 30 and 32.

A second angle $\phi 3$ is selected to define a second line through the 0 0 coordinate of the radius of generation circle, and a tangent line is taken therefrom to intersect the involute wrap at point E near the inner end. At point E, a second thickness Tm of the modified involute wrap is selected such that Tm is greater than the thickness T1. Finally, a third point A2 is determined by defining an inner tip radius I so that 21 is substantially equal to a thickness T1.

The (x,y) location of point A is determined according to the following formulae:

$$x=[[(Rg \times \phi 3)-T1/2-R1]\times \cos \phi 3]+[R1 \times \cos(\phi 3-\delta)]-(Rg \times \sin \phi 3)$$

$$y=[[R1-(Rg \times 3)+T1/2]\times \sin \phi 3]-[R1\times \sin(\phi 3-\delta)]-(Rg \times \sin \phi 3)$$

The (x.y) location of point E is determined according to the following formulae:

$$x=[[(Rg \times \phi m)+T1/2-Tm]\times \cos \phi m]-(Rg \times \sin\phi m)$$

$$y=[[-Rg \times \phi m)-T1/2+Tm]\times \sin \phi m]-(Rg \times \cos \phi m)$$

Construction lines are then defined from point A to point E and from point E to point A2, and the normal bisectors of these lines A-E and E-A2 define a point P1 about which an arcuate portion A-E-A2 is fitted to connect the sub-arc A-B to the inner tip portion of the involute wrap. The arcuate portion A-E-A2 is tangent to the inner tip portion radius I at the point A2. It should be noted that, while the arcuate portion A-E-A2 is preferably formed as a circular arc, it may alternatively be formed as a portion of an involute generated about an alternative, Rg or angle of generation $\phi 0$.

Figure 3A:
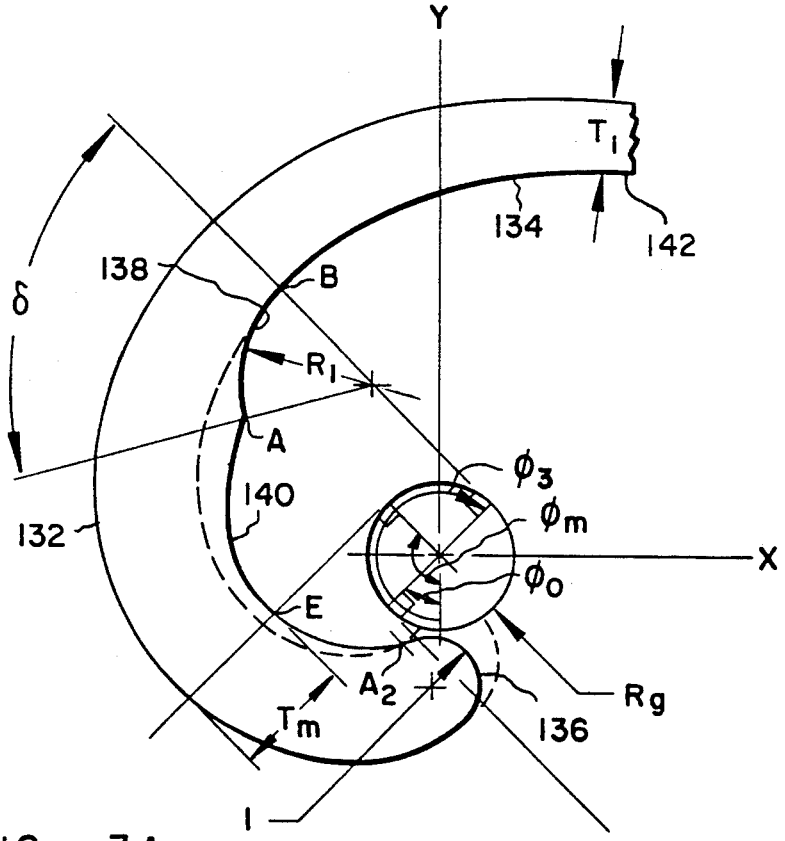
FIG. 3A illustrates an alternative embodiment of the scroll of FIG. 3.
Figure 4A:
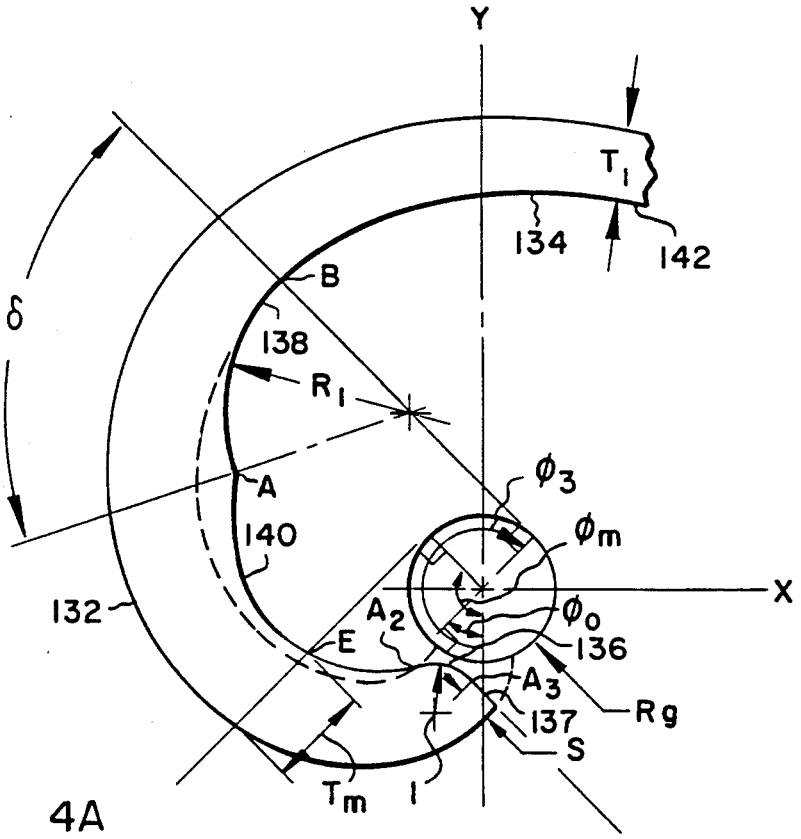
FIG. 4A illustrates an alternative embodiment of the scroll of FIG. 4.

Such an alternative embodiment of FIG. 3 is depicted in FIG. 3A and of FIG. 4 in FIG. 4A.

The involute scroll wrap in FIG. 4 is an alternative embodiment of the involute wrap of FIG. 3, shown generated about the same angle of generation $\phi 0$ for ease of comparison. The involute scroll wrap in FIG. 4 is generated beyond the inner tip portion 136 as described above for the involute scroll wrap in FIG. 3 However the inner tip radius I is provided on an inner tip portion adjoining point A2 and a point A3, where A3 is removed by a planar surface 137 of width S which is tangent to the inner tip portion 136 at point A3 and normal to the outer wall surface 132. Also, the arc portion 140 in this embodiment may be generated by selecting an alternative angle of generation $\phi 0$ to generate an alternative involute arc portion extending between points A and A2. Those skilled in the art will recognize that the conformation of the inner tip portion may also be varied in other alternative embodiments without materially affecting the subject invention, and will also recognize that the angle of generation $\phi 0$ need not be identical in both scrolls 30 and 32 even in a scroll apparatus 20 employing both the foregoing alternative embodiments.

The operation of the preferred embodiment is depicted generally in FIGS. 5 through 8. Subscripted characters f and o are used in conjunction with the reference numerals to indicate fixed and orbiting, respectively Those skilled in the art will recognize that some dimensional differences may result when applying the subject invention as shown in FIGS. 3 and 4 as fixed or orbiting involute scroll wrap elements 30 and 32. For example, $\delta_f$ will not necessarily equal $\delta_o$. It will be appreciated that any such differences do not materially alter the subject invention.

In FIG. 5, the orbiting scroll 32 has moved to a position such that the inner tip portion $\mathbf{136}_o$ engages the arc portion $\mathbf{138}_f$ at point $B_f$, and the inner tip portion $\mathbf{136}_f$ of the fixed scroll 30 engages the arc portion $\mathbf{138}_o$ at point $B_o$. Compression of the fluid in chambers 120a and 120b is taking place, as it would in a scroll apparatus having an unmodified scroll profile.

In FIG. 6, the orbiting scroll 32 has moved to an intermediate position. Because the arc portions $\mathbf{138}_f$ and $\mathbf{138}_o$ are thicker than the unmodified involute T1, the inner tip portions $\mathbf{136}_o$ and $\mathbf{136}_f$ remain in moving line contact with the opposed respective arc portions $\mathbf{138}_f$ and $\mathbf{138}_o$, continuing the compression of fluid retained in the compression chambers 120a and 120b.

In FIG. 7, the orbiting scroll 32 can be seen to have moved to a position such that the respective inner tips 136o and 136f are in moving line contact with the respective arc portions 138f and 138o at points $A_f$ and $A_o$. Because of this continuing moving line contact, the period of final compression in the compression chambers 120a and 120b is extended, as the fluid in the compression chambers 120a and 120b is not yet able to vent past the inner tip portions 136a and 136b to the discharge port 26.

By comparison, in a scroll apparatus employing unmodified scroll wrap involutes, the compression chambers 120a and 120b would begin to communicate with the discharge port 26 after assuming the Position shown in FIG. 5, since the moving line contact between the respective inner tip portions $\mathbf{136}_f$ and $\mathbf{136}_o$ with the inner wall surfaces $\mathbf{134}_o$ and $\mathbf{134}_f$ would be broken at or in the immediate vicinity of points $B_o$ and $B_f$.

Finally, in FIG. 8 it can be seen that the moving line contact is broken as the orbiting scroll wrap continues in its orbit beyond the points $A_o$ and $A_f$. At this point, the orbiting scroll wrap 32 is moving away from the fixed scroll wrap 30, permitting fluid to discharge from the compression chamber 120a through a port area Da and from the compression chamber 120b through a port area Db As the orbiting scroll wrap 32 moves away from the fixed scroll wrap 30, the respective inner tip portions $\mathbf{136}_o$ and $\mathbf{136}_f$ are adjacent the portions 140f and 140o. It will be noted that the thickness of the scroll wraps 30 and 32 decreases from the points $A_f$ to $A2_f$ and $A_o$ to $A2_o$, so that as the orbiting scroll wrap 32 passes the fixed scroll wrap 30 adjacent the connection portions $\mathbf{140}_f$ and $\mathbf{140}_o$, the connecting portions $\mathbf{140}_f$ and $\mathbf{140}_o$ tend also to drop away from the inner tip portions $\mathbf{136}_o$ and $\mathbf{136}_f$. Therefore, the discharge area Da and Db tends to increase very rapidly as the orbiting scroll wrap 32 moves past the points $A_o$ and $A_f$. This rapid increase in the discharge areas Da and Db permits a rapid discharge of the compressed fluid from the compression chambers 120a and 120b.

Figure 9:
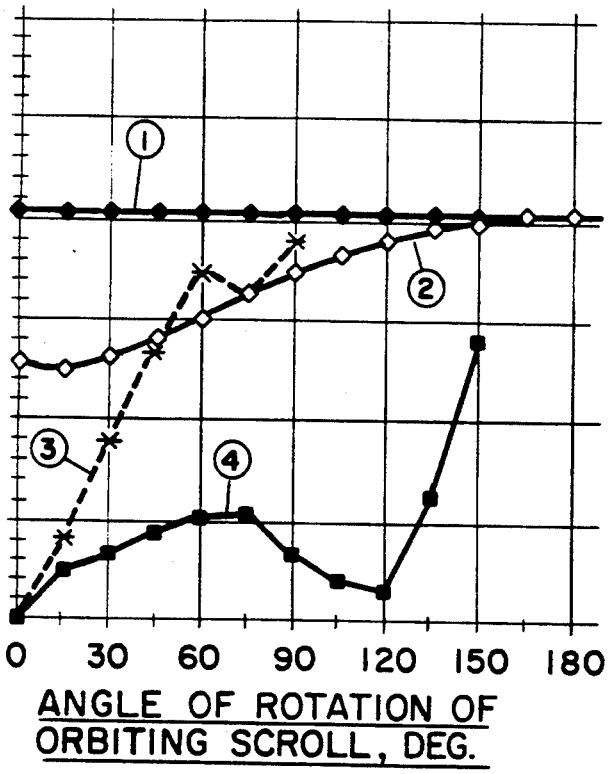
FIG. 9 is a graphic representation of the discharge flow area available in comparable scroll apparatus including the subject invention and not including the subject invention.

FIG. 9 generally shows the availability of the discharge area Da as compared to one half of the port area defined by the discharge port 26 during the orbit of the orbiting scroll wrap in a scroll apparatus employing the subject invention as compared to that of a scroll apparatus having unmodified involute wraps for an apparatus of arbitrary capacity The area of the discharge port 26 is fixed, but is blocked partially at certain angles of rotation by the orbiting scroll wrap 32, reducing the area available to permit discharged fluid flow. The angle of rotation is taken with respect to the point at which porting begins. Because of the relatively slow opening of the discharge area Da between the inner tip portions of the involutes in a scroll apparatus having an unmodified scroll wrap, it is often necessary to provide a recess in the orbiting scroll wrap end plate corresponding to the discharge port in the fixed scroll wrap to increase the flow from the compression chambers 120 to the discharge port 26. In the subject invention, it is unnecessary to provide this recess.

In FIG. 9, line 1 represents one-half of the total area of the discharge port 26; line 2 represents one-half of the total area of the discharge port 26 available due to blockage by the orbiting scroll 32; line 3 represents the flow area Da available in the scroll apparatus 20; and line 4 represents the flow area Da in a scroll apparatus having conparable capacity with unmodified scroll wrap involutes.

Figure 10:
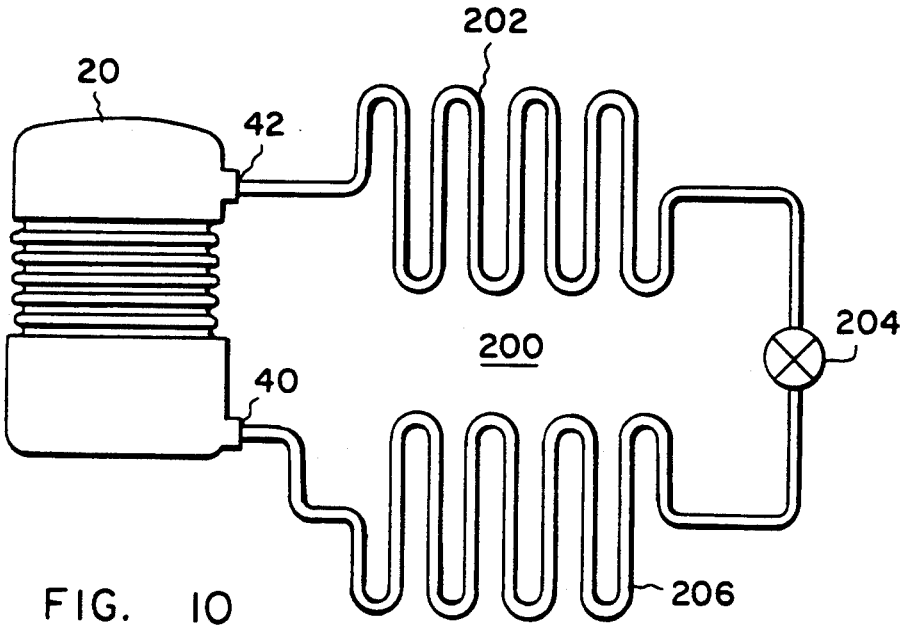
FIG. 10 is a schematic representation of a suitable refrigeration system employing the subject invention.

A suitable refrigeration system 200 incorporating the scroll apparatus 20 is schematically depicted in FIG. 10. This system 200 circulates refrigerant in closed loop connection and is comprised of a condenser 202 for condensing refrigerant to liquid form, an expansion valve 204 for receiving liquid refrigerant from said condenser and expanding the refrigerant, an evaporator 206 for receiving liquid refrigerant from said expansion valve and evaporating the refrigerant, and the refrigerant compressor 20 for receiving expanded refrigerant from said evaporator 206 and compressing the refrigerant, whereupon the refrigerant is recirculated to the condenser 202.

In reviewing FIGS. 2 through 8, it will be apparent to those skilled in the art that the modified scroll profiles as shown in FIG. 3 and FIG. 4 could be applied in various combinations. It is feasible to use the involute wrap depicted in FIG. 3 as either the orbiting scroll wrap 32 or as the fixed involute wrap 30 in combination with the involute wrap depicted in FIG. 4 as the corresponding involute wrap 30 or 32. It would be equally feasible to employ the scroll profile of FIG. 3 on both the orbiting involute wrap 32 and the fixed involute wrap 30 or to use the involute wrap shown in FIG. 4 on both the fixed involute wrap 30 and the orbiting involute wrap 32. It is also feasible to employ the scroll profile of FIG. 3 or of FIG. 4 as either the fixed involute wrap 30 and the orbiting involute wrap 32 in concert with a scroll wrap of unmodified profile to obtain the invention's performance and efficiency improvements over scroll apparatus having only scroll wraps of unmodified profile.

Therefore, it can be seen that the subject invention provides substantial improvement over the prior art in terms of discharge pressure, power consumption, and operating efficiency of a scroll apparatus having scroll elements of a given size. This will therefore reduce the size of the scroll apparatus required for a given capacity, and in turn, the manufacturing and material costs for a scroll apparatus. It will also be noted that the increased thickness of the scroll wraps 30 and 32 adjacent the inner tip portions 156 and 136 also provides a scroll apparatus of greater reliability with less likelihood of failure due to the mechanical loads imposed upon the scroll wraps 30 and 32. IT will also be noted that the elimination of the requirement for a recess in the orbiting scroll wrap end plate to aid the discharge flow will further increase the strength of the orbiting scroll end plate and renders unnecessary the machining operation for forming such a recess as well. It will be appreciated additionally tat the subject invention provides a relatively inexpensive means for obtaining these substantial advantages over the prior art.

Modifications to the preferred embodiment of the subject invention will be apparent to those skilled in the art within the scope of the claims that follow hereinbelow.

What is claimed is:

1. A scroll apparatus comprised of:

a first scroll element defined by a first upstanding involute scroll wrap element having a first outer wall and a first inner wall extending between a first inner tip portion and a first outer end, said first outer wall and said first inner wall defining a first wrap thickness T therebetween, said first inner wall further including a first inner wall surface extending from said first inner tip portion, said first inner wall surface including a first point $A_f$ and a second point $B_f$ defined thereon, said first inner wall surface further defined by an arcuate portion extending between said first inner tip portion and said first point $A_f$ and a circular arc portion extending from said point $A_f$ to said point $B_f$, wherein said first wrap thickness T is greater between said first inner tip portion and said second point $B_f$ than between said second point $B_f$ and said first outer end;

a second scroll defined by a second upstanding involute scroll wrap element for interleaving engagement with said first involute scroll wrap element, said second involute scroll wrap element including a second outer wall and a second inner wall extending between a second inner tip portion and a second outer end, said second outer wall and said second inner wall defining a second wrap thickness T therebetween, said second inner wall further including a second inner wall surface extending from said second inner tip portion, said second inner wall surface including a first point $A_o$ and a second point $B_o$-defined thereon, said second inner wall surface further defined by an arcuate portion extending from said second inner tip portion to said point $A_o$ and a circular arc portion extending from said point $A_o$ to said point $B_o$ of a circle, wherein said second wrap thickness T is greater between said second inner tip portion and said second point $B_o$ than between said second point $B_o$ and said second outer end, whereby when said second scroll orbits with respect to said first scroll, said second inner tip portion engages in moving line contact said first inner wall surface from said point $B_f$ to said point $A_f$ while said fist inner tip portion simultaneously engages in moving line contact said second inner wall surface from said point $B_o$ to said point $A_o$ during a portion of said orbit.

2. The scroll apparatus as set forth in claim 1 wherein said first inner tip portion is characterized by a circular arc portion about a center disposed in said wrap.

3. The scroll apparatus as set forth in claim 2 wherein said second inner tip portion is characterized by a linear portion adjoining said outer wall and a circular arc portion having a center disposed in said wrap, said circular arc portion adjoining said inner wall and said linear portion.

4. The scroll apparatus as set forth in claim 1 wherein at least one said arcuate portion is a circular arc.

5. The scroll apparatus as set forth in claim 1 wherein at least one said arcuate portion is an involute portion.

6. The scroll apparatus as set forth in claim 1 wherein said fist scroll further includes an outer involute wall surface extending from said first inner tip portion for defining a thickness of said first scroll between said inner wall surface and said outer wall surface, and said second scroll further includes an outer involute wall surface extending from said second inner tip portion for defining a thickness of said second scroll between said inner wall surface and said outer wall surface.

7. The scroll apparatus as set forth in claim 6 wherein said first scroll thickness increases from said first inner tip portion to said point $A_f$ and decreases from said point $A_f$ to said point $B_f$, and said second scroll thickness increases form said second inner tip portion to said point $A_o$ and decreases from said point $A_o$ to said point $B_o$.

8. The scroll apparatus as set forth in claim 7 wherein said scroll apparatus further includes a motor operably connected to one of said scroll elements for driving said scroll elements in respective orbital motion.

9. A scroll apparatus comprised of:

a first scroll element defined by a first upstanding involute scroll wrap element, said fist involute scroll wrap element including a first outer wall surface, a first inner wall surface and a first inner tip portion, said first inner wall surface including a fist point $A_f$ and a second point $B_f$ defined thereon, said first inner all surface further defining a fist portion beginning adjacent said first inner tip portion and extending to said point $A_f$ wile diverging from said first outer wall to define a portion of said fist involute scroll wrap element having an increasing thickness from the first inner tip portion to said point $A_f$, said fist inner wall defining a circle arc portion extending from said point $A_f$ to said point $B_f$ while converging toward said first outer wall to define a portion of said first involute scroll wrap element having a decreasing thickness from said point $A_f$ to said point $B_f$, said first inner wall surface defining an involute extending from said point $B_f$;

a second scroll element defined by a second upstanding involute scroll wrap element for interleaving engagement with said fist involute scroll wrap element, said second involute scroll wrap element including a second outer wall surface, a second inner wall surface, and a second inner tip portion, said second inner wall surface including a first point $A_o$ and a second point $B_o$ defined thereon, said second inner wall surface further defining a first portion beginning adjacent said second inner tip portion and extending to said point $A_o$ while diverging from said second outer wall to define a portion of said second involute scroll wrap element having an increasing thickness from said second inner tip to said point $B_o$, said second inner wall surface defining a circular arc portion extending from said point $A_o$ to said point $B_o$ while converging toward said second outer wall to define a portion of said second involute scroll wrap element having a decreasing thickness from said point $A_o$ to said point $B_o$, said second inner wall surface defining an involute extending from said point $B_o$, whereby when said first scroll orbits with respect to said second scroll, said second inner tip portion engages in moving line contact said first inner wall surface from said point $B_f$ to said point $A_f$ while said first inner tip portion simultaneously engages in moving line contact said second inner wall surface from said point $B_o$ to said point $A_o$ during a portion of said orbit.

10. The scroll apparatus as set forth in claim 9 wherein said first and second scroll elements are disposed in a hermetic shell.

11. The scroll apparatus as set forth in claim 10 wherein said scroll apparatus further includes a motor operably connected to one of said scroll elements for driving said scroll elements in respective orbital motion.

12. A refrigeration system for circulating refrigerant in closed loop connection comprised of:

a condenser for condensing refrigerant to liquid form;

an expansion valve for receiving liquid refrigerant from said condenser and expanding the refrigerant;

an evaporator for receiving liquid refrigerant from said expansion valve and evaporating the refrigerant; and a scroll apparatus comprising a compressor for receiving expanded refrigerant from said evaporator and compressing the refrigerant, said scroll apparatus including:

a first scroll element defined by a first upstanding involute scroll wrap element, said first involute scroll wrap element including a first outer wall surface, a first inner wall surface and a first inner tip portion, said first inner wall surface including a first point $A_f$ and a second point $B_f$ defined thereon, said first inner wall surface further defining a first portion beginning adjacent said first inner tip portion and extending to said point $A_f$ while diverging from said first outer wall surface to define a portion of said first involute scroll wrap element having an increasing thickness from the first inner tip portion to said point $A_f$, said first inner wall surface defining an arcuate portion extending from said point $A_f$ to said point $B_f$ while converging toward said first outer wall to define a portion of said first involute scroll wrap element having a decreasing thickness from said point $A_f$ to said point $B_f$, said first inner wall extending from said point $B_f$;

a second scroll element disposed in said hermetic shell, said second scroll defined by a second upstanding involute scroll wrap element for interleaving engagement with said first involute scroll wrap element, said second involute scroll wrap element including a second outer wall surface, a second inner wall surface, and a second inner tip portion, said second inner wall surface including a first point $A_o$ and a second point $B_o$ defined thereon, said second inner wall surface further defining a first portion beginning adjacent said second inner tip portion and extending to said point $A_o$ while diverging from said second outer wall surface to define a portion of said second involute scroll wrap element having an increasing thickness from said second inner tip to said point $B_o$, said second inner wall surface defining an arcuate portion extending from said point $A_o$ to said point $B_o$ while converging toward said second outer wall surface to define a portion of said second involute scroll wrap element having a decreasing thickness from said point $A_o$ to said point $B_o$, said second inner wall surface extending from said point $B_o$, whereby when said first scroll orbits with respect to said second scroll, said second inner tip portion engages in moving line contact said first inner wall surface from said point $B_f$ to said point $A_f$ while said first inner tip portion simultaneously engages in moving line contact said second inner wall surface from said point $B_o$ to said point $A_o$ during a portion of said orbit.

13. The refrigeration system as set forth in claim 12 wherein said first and second scroll elements of said scroll apparatus are disposed in a hermetic shell.

14. The refrigeration system as set forth in claim 13 wherein said scroll apparatus further includes a motor operably connected to one of said scroll elements for driving said scroll elements in respective orbital motion.

* * * * *

UNITED STATES PATENT AND TRADEMARK OFFICE

CERTIFICATE OF CORRECTION

PATENT NO. : 5,056,336

DATED : October 15, 1991

INVENTOR(S) : Mark W. Harrison

It is certified that error appears in the above-identified patent and that said Letters Patent is hereby corrected as shown below:

Column 1, Line 51, after the word "apparatus" insert --.--.

Column 1, Line 58, after the word "apparatus" insert --.--.

Column 1, Line 60, after the word "chambers" insert --,--.

Column 2, Line 47, after the word "element" insert --.--.

Column 2, Line 50, after the word "compression" insert --.--.

Column 2, Line 57, after the word "plate" insert --.--.

Column 4, Line 16, "vertical" should read --vortical--.

Column 4, Line 19, "vertical" should read --vortical--.

Column 4, Line 56, after "38" insert --.--.

Column 5, Line 56, after "136" insert --.--.

Column 5, Line 65, after "32" insert --.--.(1st Occur)

Column 6, Line 24, before the word "negative" insert --positive Y axis, Mm, which is measured clockwise from the--.

Column 6, Line 41, after "used" insert --.--.

Column 6, Line 43, after "larger" insert --ø--.

Column 6, Line 48, after "ratio" insert --.--.

Column 6, Line 63, "through the 0 0 should read --through the 0,0--.

Column 8, Line 24, "Position" should read --position--.

Column 8, Line 36, after the word "Db" insert --.--.

Column 9, Line 56, "IT" should read --It--.

Column 9, Line 62, "tat" should read --that--.

UNITED STATES PATENT AND TRADEMARK OFFICE

CERTIFICATE OF CORRECTION

PATENT NO. : 5,056,336

DATED : October 15, 1991

INVENTOR(S) : Mark W. Harrison

It is certified that error appears in the above-identified patent and that said Letters Patent is hereby corrected as shown below:

Column 10, Claim 1, Line 45, "fist" should read --first--.

Column 10, Claim 6, Line 63, "fist" should read --first--.

Column 11, Claim 9, Line 16, "fist" should read --first--.

Column 11, Claim 9, Line 20, "fist" should read --first--.

Column 11, Claim 9, Line 21, "all" should read --wall--.

Column 11, Claim 9, Line 21, "fist" should read --first--.

Column 11, Claim 9, Line 23, "wile" should be --while--.

Column 11, Claim 9, Line 25, "fist" should read --first--.

Column 11, Claim 9, Line 27, "fist" should read --first--.

Column 11, Claim 9, Line 37, "fist" should read --first--.

Signed and Sealed this

Twenty-third Day of March, 1993

*Attest:*

STEPHEN G. KUNIN

*Attesting Officer*

*Acting Commissioner of Patents and Trademarks*